US005456369A

United States Patent [19]

Smed

[11] Patent Number: 5,456,369

[45] Date of Patent: Oct. 10, 1995

[54] TELEPHONE DIRECTORY STORAGE DEVICE AND METHOD

[75] Inventor: Ole F. Smed, 12 Willow Park Green Southeast, Calgary, Alberta, Canada, T2J 3L1

[73] Assignee: Ole F. Smed, Alberta, Canada

[21] Appl. No.: 164,347

[22] Filed: Dec. 9, 1993

[51] Int. Cl.[6] ..... A47F 7/00

[52] U.S. Cl. ..... 211/42; 211/46; 312/184

[58] Field of Search ..... 211/42, 43, 46, 211/162, 45, 113, 191; 312/184

[56] References Cited

U.S. PATENT DOCUMENTS

| | | | |
|---|---|---|---|
| 1,851,595 | 3/1932 | Rand | 312/184 X |
| 2,087,149 | 7/1937 | Hendrix | 211/46 X |
| 2,678,651 | 5/1954 | DeWhalley | 211/162 |
| 2,918,176 | 12/1959 | Bell et al. | 211/191 |
| 2,925,086 | 2/1960 | Stark | 312/184 |
| 3,162,417 | 12/1964 | Briggs | 211/162 X |
| 3,174,626 | 3/1965 | West | 211/42 |
| 3,977,527 | 8/1976 | Rose et al. | 211/46 |
| 4,217,008 | 8/1980 | Wright et al. . | |
| 4,530,176 | 7/1985 | Rejwan | 312/184 X |
| 4,711,419 | 12/1987 | Polosky . | |
| 4,718,562 | 1/1988 | Winkler | 211/113 X |
| 5,096,227 | 3/1992 | Pinkerton, Jr. . | |
| 5,186,497 | 2/1993 | Van Pinkerton, Jr. . | |
| 5,197,762 | 3/1993 | Abramov | 211/46 X |

*Primary Examiner*—Robert W. Gibson, Jr.
*Attorney, Agent, or Firm*—Hardaway Law Firm

[57] ABSTRACT

Disclosed is an efficient and simple device and method for storing books such as telephone directories. This device supplements normal hanging vertical files such as produced by PENDAFLEX (TM) and, therefore, requires no substantial installation.

6 Claims, 2 Drawing Sheets

TELEPHONE DIRECTORY STORAGE DEVICE AND METHOD

DESCRIPTION OF THE PRIOR ART

Because of the particular nature of flimsy softbound books 1, such as telephone directories, storing them has been a problem. Telephone directories are usually very thick and lack rigid covers like normal books. Therefore, they are prone to (FIG. 1A) have the pages bend over a bookend or, in some instances, (FIG. 1B) the telephone directories actually fall over when their adjacent support is weakened by, for example, the removal of an adjacent book. Furthermore, because the shelf is not always next to the telephone, someone who needs the telephone directory, to make a phone call, must get up from their seat to go get it.

While methods for specifically storing telephone directories have been used by the prior art, these methods have been limited to telephone booths where there is a real threat of having the telephone directory stolen. Therefore, in the prior art, the telephone directory has usually been rigidly attached to the holder and phone booth in some way. This would not be helpful in home or office applications.

SUMMARY OF THE INVENTION

The instant invention is directed to a simple and efficient method of storing books both at home and at the office. The invention is very easy to implement because it is merely an addition to the prior art hanging vertical files, such as currently produced by PENDAFLEX (TM), and already extensively used both at home and at the office. A thin metal beam is placed across the rails of the vertical filing system and the book is hung on the metal member by slipping the member in between pages of the book and letting the spine of the book rest on the member.

While prior art newspaper and magazine hanging systems have been used in libraries, these require special racks for supporting the beams that hold the magazines or newspapers. Furthermore, because the beam is usually attached to the newspaper or magazine, it makes the newspaper or magazine a more cumbersome item to handle.

OBJECTS OF THE INVENTION

It is an object of the invention to create a means by which telephone directories can be easily stored.

It is a further object of the invention to create a means by which telephone directories can be stored directly at a person's desk, yet out of the way.

It is a further object of the invention to create a means by which telephone directories can be stored that does not require any major installation.

These and other objects of the invention are achieved by: a device for storing books comprising: a support having at least two sides; two parallel rails mounted to the support and adjacent the sides of the support; and a beam spanning the rails; whereby by spreading the pages of the book the beam may be slipped in between the pages allowing the book to be hung on the beam.

DETAILED DESCRIPTION OF THE DRAWINGS

Figure 1A:
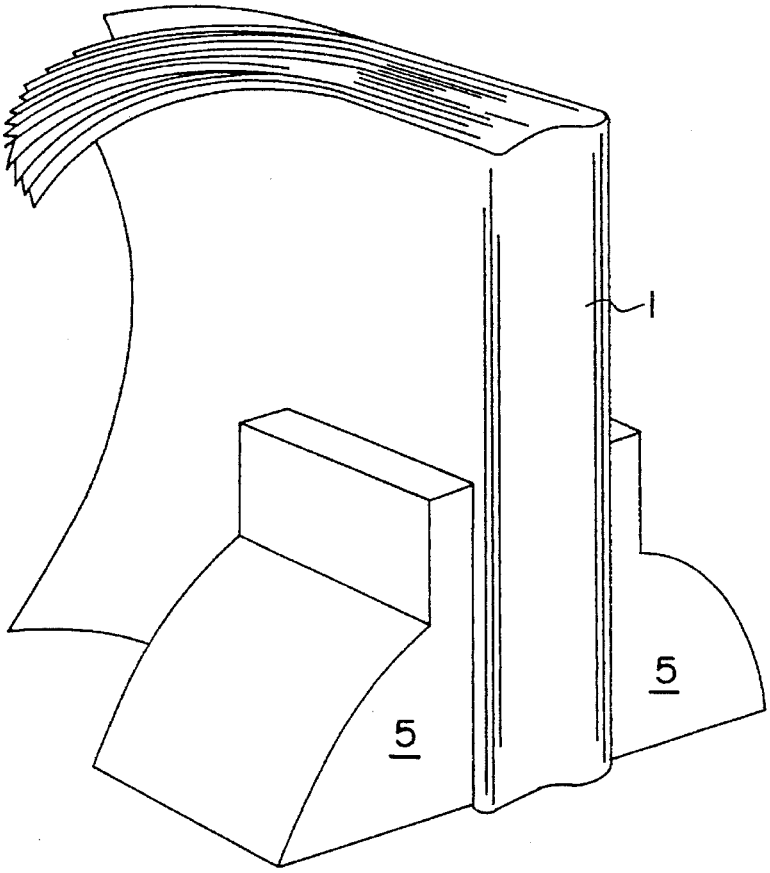
FIGS. 1A, 1B show prior art methods of storing telephone directories emphasizing their ineffectiveness.
Figure 1B:
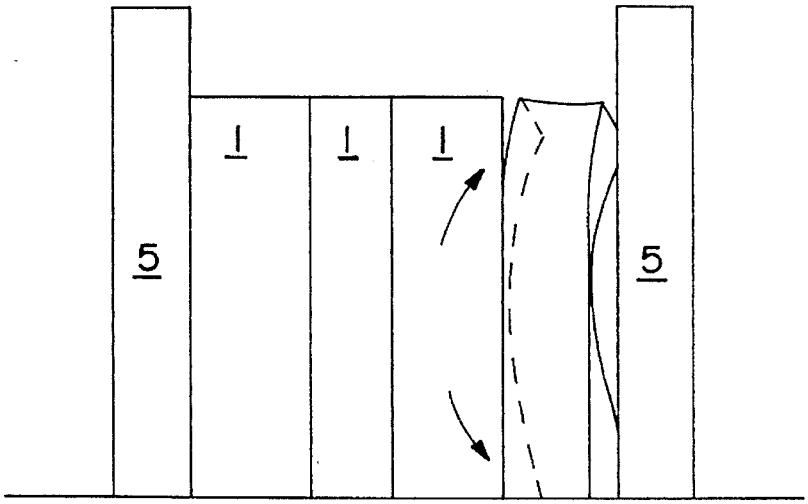
Figure 2:
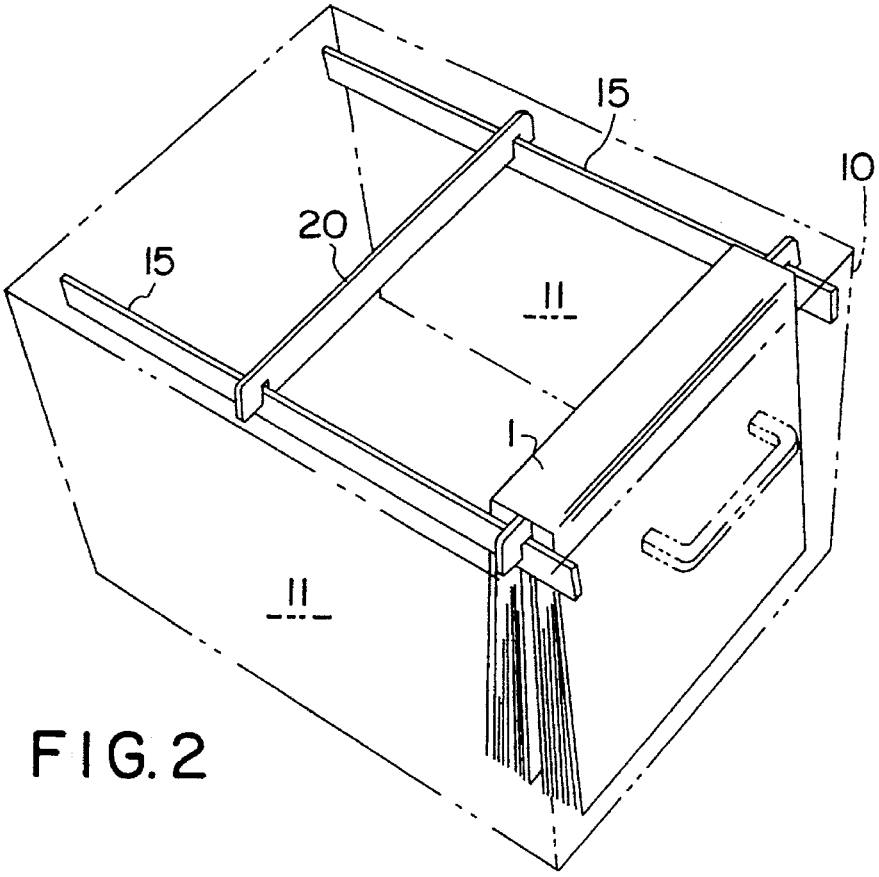
FIG. 2 shows a perspective view of a means for storing telephone directories according to the invention.

FIG. 2 shows a perspective view of a means for storing books according to the invention. While the invention is specifically disclosed as being used with telephone directories, it is conceived that it can be used to store any type of book although the problems shown by FIGS. 1A and 1B are more prevalent when storing thick soft-covered books such as telephone directories.

A support 10, in the form of either a drawer of a desk or a hanging-type vertical file, is used for storing the books. This support 10 has two parallel rails 15 extending along the length of the support 10 and spaced a small distance from walls 11 of the support 10. These railings are for hanging file folders thereon.

Figure 4:
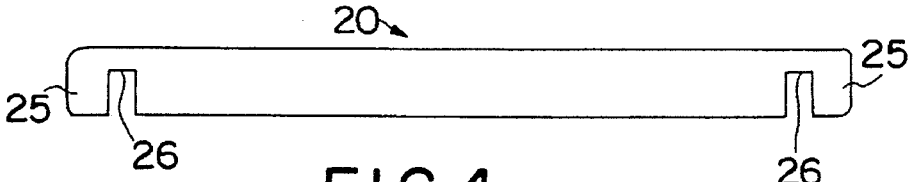
FIG. 4 shows a bracket for use in supporting telephone directories according to the invention.

According to the invention, however, a beam 20 spans across the two railings 15. As shown in FIG. 4, this beam 20 has two hook portions 25 defining two cut-out portions 26. However, these beams 20 can have any shape. The cut-out portions receive the rails 15 and allow the beam 20 to be supported on the rails 15 without easily falling off. While it is preferred that the beam 20 is made out of a 16 gauge metal, it can be made out of any material.

Figure 3:
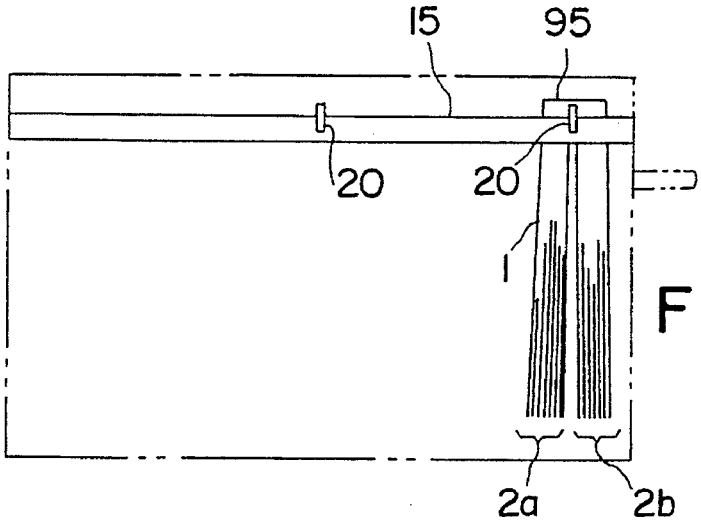
FIG. 3 shows a side view of the means for storing telephone directories according to the invention.

As shown in FIG. 3, after the beam 20 is hung on the rails 15, a telephone directory 1 may be hung thereon. A person would then spread the pages of the book into two groups 2*a* and 2*b*, preferably in the middle of the book, and slip the beam 20 inbetween. The person would then slowly lower the book onto the beam until the binding 95 of the book rests upon the beam 20. Then, if, for example, the support 10 is in the form of a desk drawer, the drawer would be closed and the book effectively stored next to the telephone yet out of the way.

The above description is given in reference to a telephone directory storage system and method. However, it is understood that many variations are apparent to one of skill in the art from a reading of the above specification and such variations are within the spirit and scope of the instant invention as defined by the following appended claims.

That which is claimed:

1. A combination of a device for storing thick books having spines and at least one thick book having a spine comprising:

a support having at least two sides;

two parallel rails mounted to said support and adjacent said sides of said support; and a beam spanning said rails, wherein said beam comprises a hook portion on each of its ends defining a rectangular cut-out portion, said rectangular cut-out portion has a width substantially equal to a width of said rails, and whereby said rails may be received in said cut-out portions;

whereby by spreading the pages of said thick book said beam may be slipped between the pages allowing said spine of said thick book to be hung on said beam, said thick book never being securely attached to said beam.

2. The combination according to claim 1, wherein said support comprises a desk drawer.

3. The combination according to claim 1, wherein said beam is constructed out of a 16 gauge metal.

4. A method of storing at least one telephone directory comprising:

supporting two parallel rails at a height substantially equal to a width of said telephone directory;

placing a beam across said rails;

spreading the pages of said telephone directory in order to form the pages of the telephone directory into two spaced-apart groups;

slipping the telephone directory over the beam so as to receive the beam in the space between the two groups of pages; and resting a spine of the telephone directory on the beam.

5. A combination of a device for storing at least one telephone directory and at least one telephone directory comprising:

a support having at least two sides;

two parallel rails mounted to said support and adjacent said sides of said support; and a single beam spanning said rails, said single beam having a strength capable of supporting said telephone directory;

whereby by spreading the pages of said telephone directory said beam may be slipped between the pages allowing said telephone directory to be hung on said beam.

6. The combination according to claim 5, wherein said beam is constructed out of a 16 gauge metal.

* * * * *